United States Patent [19]

Lelental et al.

[11] 4,435,490

[45] Mar. 6, 1984

[54] ELECTRICALLY ACTIVATABLE RECORDING ELEMENT AND PROCESS

[75] Inventors: Mark Lelental; David J. Steklenski, both of Rochester, N.Y.

[73] Assignee: Eastman Kodak Company, Rochester, N.Y.

[21] Appl. No.: 454,572

[22] Filed: Dec. 30, 1982

[51] Int. Cl.[3] ..... G03G 13/01

[52] U.S. Cl. ..... 430/45; 430/46; 430/48; 430/52; 430/60; 430/62; 430/66; 430/495; 430/496; 346/153.1; 346/157; 346/76 R; 8/444

[58] Field of Search ..... 430/46, 47, 48, 52, 430/56, 60, 66, 350, 351, 353, 414, 495, 496, 964, 45

[56] References Cited

U.S. PATENT DOCUMENTS

| | | | |
|---|---|---|---|
| 3,898,458 | 8/1975 | Reithel | 250/315 |
| 4,042,392 | 8/1977 | Gysling et al. | 96/48 PD |
| 4,113,484 | 9/1978 | Lelental et al. | 96/1 R |
| 4,131,463 | 12/1978 | Tsuboi et al. | 96/1 E |
| 4,201,583 | 5/1980 | Reithel | 430/97 |
| 4,234,670 | 11/1980 | Kaukeinen et al. | 430/52 |
| 4,309,497 | 1/1982 | Lelental et al. | 430/48 |
| 4,332,875 | 6/1982 | Lelental et al. | 430/45 |

OTHER PUBLICATIONS

*Research Disclosure,* Oct. 1979, Item No. 18625.
*Research Disclosure,* Dec. 1978, Item No. 17643.
*Research Disclosure,* Oct. 1979, Item No. 18627.

*Primary Examiner*—John E. Kittle
*Assistant Examiner*—José G. Dees
*Attorney, Agent, or Firm*—Richard E. Knapp

[57] ABSTRACT

An electrically activatable recording (EAR) element capable of producing a positive image comprises an electrically activatable recording layer comprising a transition metal complex selected from the group consisting of Group VIIIB and Group IB metal complexes in a film forming ionic polymer that is capable of undergoing an imagewise reorientation upon exposure to electric current and, upon such exposure, development of an image in the exposed areas of the recording layer is restricted. The recording element is light handleable and provides a non-silver positive image upon exposure and processing.

27 Claims, 5 Drawing Figures

LATENT IMAGE FORMATION

HEAT DEVELOPMENT

LATENT IMAGE FORMATION

ELECTRICALLY ACTIVATABLE RECORDING ELEMENT AND PROCESS

BACKGROUND OF THE INVENTION

1. Field of the Invention

This invention relates to an electrically activatable recording element and process for forming a non-silver position image by means of a recording layer comprising (a) a transition metal complex and (b) a film forming ionic polymer that is capable of undergoing an imagewise reorientation upon exposure to electric current and as a result of the exposure, development of the metal complex in the exposed areas of the recording layer is restricted.

2. Description of the State of the Art

Production of an image in an electrically activatable recording (EAR) element is known. This is described in, for example, U.S. Pat. No. 4,234,670. Such EAR elements are useful for forming negative images. A problem exists in such elements in forming positive images which are formed only with an evaporated nuclei layer or a surface fogged photographic silver halide. An electrically activatable recording element designed for formation of a positive image by means of surface fogged silver halide, such as described in *Research Disclosure,* October 1979, Item No. 18625, is more expensive to manufacture than a non-silver imaging material. An electrically activatable recording element designed for formation of a positive image by means of an evaporated nuclei layer, such as described in U.S. Pat. No. 4,113,484, is also expensive to manufacture. The answer to the problem of forming a positive image in an electrically activatable recording element without such disadvantages is not found in the prior art.

SUMMARY OF THE INVENTION

It has been found according to the invention that a positive image is produced in an electrically activatable recording element comprising an electrically activatable recording layer comprising a transition metal complex selected from the group consisting of Group VIIIB and Group IB metal complexes in a film forming ionic polymer that is capable of undergoing an imagewise reorientation upon exposure to electric current and upon such exposure, development in the exposed areas of the recording layer is restricted. The EAR element is light handleable without the need for dark room conditions for manufacture, exposure and processing. The EAR element provides a non-silver positive image upon exposure and processing.

An electrically activatable recording process for producing a positive image in an EAR element according to the invention comprises physical development of the latent image produced in the electrically activatable recording layer. For example, an electrically activatable recording process comprises the steps of:

(I) applying an electrical potential imagewise to the EAR element of the invention of a magnitude and for a time sufficient to produce in the image areas a charge density within the range of about $10^{-2}$ to about $10^{-8}$ coulombs/cm$^2$, said charge density forming a latent image in the recording layer;

(II) laminating the resulting EAR element in face-to-face relationship with a dry physical developer element; and, (III) heating the laminate resulting from step (II) to a temperature and for a time sufficient to develop the latent image in the recording layer. The laminate can be delaminated after heating in step (III).

Various means are useful for forming a latent image in the electrically activatable recording element according to the invention. Such means include, for example, a photoconductive layer, a contact or non-contact electrode and a corona ion current flow.

The ionic polymers in the electrically activatable recording layer according to the invention are advantageous because, in addition to aiding formation of a positive image, they are easily prepared to provide desired properties, such as inherent viscosity range, molecular weight distribution, solubility, and glass transition temperature.

DETAILED DESCRIPTION OF THE INVENTION

Figure 1:
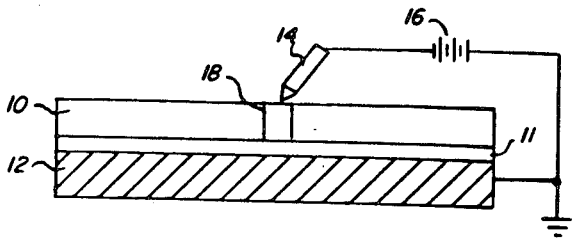
FIGS. 1 and 2 schematically illustrate an electrically activatable recording material and process according to one embodiment of the invention.

All ionic polymers having the described properties are useful in an electrically activatable recording layer according to the invention. The exact machanisms by which a latent image is formed and by which the ionic polymer enables formation of a positive image, according to the invention are not fully understood. It is postulated that the injection of a charge carrier due to the electric field into the combination of components results in the formation of a developable image in the electrically activated recording layer. For reasons not fully understood, the ionic polymer in the exposed areas of the recording layer prevents development of a developable image.

The optimum image recording combination and image recording element according to the invention will depend upon such factors as the desired image, the particular ionic polymer, the particular transition metal complex, the source of exposing energy, processing conditions, compositions and amount of current passed through the element during exposure.

The term "latent image" herein means an image that is not visible to the unaided eye or is faintly visible to the unaided eye and that is capable of amplification in a subsequent processing step, such as a subsequent physical development step.

The term "electrically conductive", such as an "electrically conductive support", herein means a material that has a resistivity less than about $10^9$ ohms/cm.

The ionic polymers useful in an electrically activatable recording layer according to the invention are prepared by methods known in the polymer art. The method of preparation is selected which produces an ionic polymer having the most useful film forming, imaging, glass transition temperature, solubility and other desired properties. An important property of the ionic polymer is the capability of the polymer to change or reorient upon electrical exposure to form a polymer which restricts development, probably by restricting penetration of developer into the recording layer, and thereby enabling formation of a positive image.

Preferred film forming ionic polymers comprise at least 10 mole percent, and preferably at least 25 mole percent of recurring units comprising ionic groups.

An example of a preferred class of ionic polymers comprises ionic polymers which are vinyl polymers comprising recurring units of the structure:

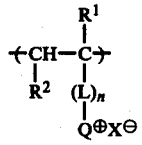

wherein

L is a linking group selected from alkylene containing 1 to 25 carbon atoms, such as methylene, ethylene, propylene, butylene and eicosylene; arylene containing 6 to 30 carbon atoms, such as phenylene and naphthalene; arylenealkylene containing 7 to 30 carbon atoms, such as phenylenemethylene; —COOR$^3$; —OCOR$^3$—; —CONHR$^3$; or taken together with R$^2$ forms a

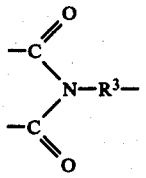

group;

R$^1$ is hydrogen or alkyl containing 1 to 4 carbon atoms, such as methyl, ethyl, propyl and butyl;

R$^2$ is hydrogen or taken together with L forms a

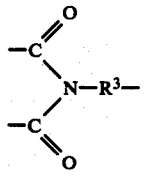

group;

R$^3$ is alkylene containing 1 to 25 carbon atoms, such as methylene, ethylene, propylene, decylene, and eicosylene; arylene containing 6 to 30 carbon atoms, such as phenylene and naphthalene; or arylenealkylene containing 7 to 30 carbon atoms such as phenylenemethylene;

Q is a cationic ammonium or phosphonium group;

n is 0 or 1; and,

X is an anion, such as chloride and p-toluenesulfonate.

In the described ionic polymer Q is, for example, a cationic group represented by the formula:

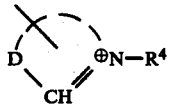

or a phosphonium group represented by the formula:

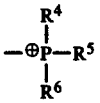

or an ammonium group represented by the formula:

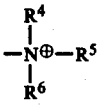

wherein

R$^4$, R$^5$ and R$^6$ are individually selected from alkyl containing 1 to 25 carbon atoms, such as methyl, ethyl, propyl, butyl, decyl and eicosylene; and aryl containing 6 to 30 carbon atoms, such as phenyl and naphthyl; and, D represents the atoms selected from the group consisting of carbon, hydrogen, nitrogen, oxygen and sulfur atoms necessary to complete a heterocyclic nucleus, such as a 5 or 6 member heterocyclic nucleus. D can represent the atoms completing, for example, a pyridinium or imidazolium heterocyclic nucleus.

A preferred polymer in an electrically activatable recording layer according to the invention is an ionic polymer which is a vinyl polymer. Preferrably the vinyl polymer is a copolymer of a comonomer selected from the group consisting of acrylate and methacrylate comonomers. Examples of such comonomers include methyl acrylate and butyl methacrylate.

Another illustrative class of ionic polymers is a copolymer of a comonomer selected from the group consisting of styrene, vinyltoluene, ethyl acrylate and butyl methacrylate.

A further illustrative class of ionic polymer is an anionic polymer comprising recurring units of the structure:

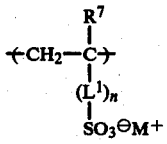

wherein

R$^7$ is hydrogen or alkyl containing 1 to 4 carbon atoms, such as methyl, ethyl, propyl and butyl;

L$^1$ is a linking group selected from alkylene containing 1 to 25 carbon atoms, such as methylene, ethylene, propylene, 2,2-dimethylethylene, decylene, and eicosylene; arylene containing 6 to 30 carbon atoms, such as phenylene and naphthylene; arylenealkylene containing 7 to 30 carbon atoms, such as phenylenemethylene; and

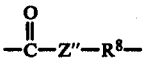

wherein

Z″ is oxygen or imino (—NH—), and

R$^8$ is alkylene containing 1 to 25 carbon atoms, such as methylene, ethylene, propylene, decylene and eicosylene; arylenealkylene containing 7 to 30 carbon atoms, such as phenylenemethylene; or arylene containing 6 to 30 carbon atoms, such as phenylene and naphthylene;

M⊕ is a cation such as sodium, ammonium, rubidium, lithium and potassium; and n is 0 or 1.

Examples of such recurring units include those derived from 3-sodiosulfopropyl acrylate, 4-sodiosulfobutyl methacrylate and 2-acrylamido-2-methylpropanesulfonate.

A further illustrative class of ionic polymers is the class of anionic polymers comprising recurring units of the structure:

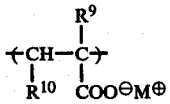

wherein $R^9$ is hydrogen or alkyl containing 1 to 4 carbon atoms, such as methyl, ethyl, propyl and butyl;

$R^{10}$ is hydrogen, alkyl containing 1 to 4 carbon atoms, such as methyl, ethyl, propyl and butyl or $COO^{\ominus}M^{\oplus}$, and M⊕ is a cation, such as sodium, lithium, ammonium, potassium and rubidium.

The ionic polymer is, for example, a cationic copolymer comprising a crosslinkable active methylene group selected from 2-acetoacetoxyethyl methacrylate, acryloylacetone, glycidyl methacrylate, and vinylbenzaldehyde groups.

Another class of preferred ionic polymers is the class of ionic condensation polymers comprising recurring units selected from the structure:

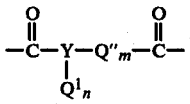

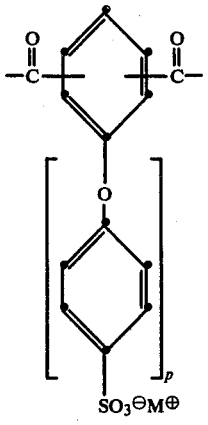

and

-continued

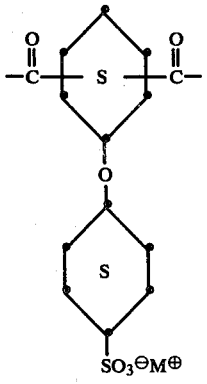

wherein n, m and p are individually 0 or 1, and the sum of n plus m is 1;

Q″ is

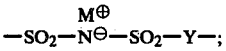

$Q^1$ is

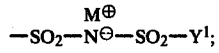

Y is phenylene or naphthylene;

$Y^1$ is alkyl containing 1 to 12 carbon atoms, such as methyl, ethyl, propyl, butyl and decyl; or aryl containing 6 to 30 carbon atoms, such as phenyl, tolyl, and naphthyl;

M⊕ is a cation, such as sodium, lithium, rubidium, ammonium and potassium.

Examples of such condensation polymers are described in, for example: U.K. Patent Specification No. 1,470,059; U.S. Pat. No. 3,546,180; U.S. Pat. No. 3,929,489; U.S. Pat. No. 3,563,942; U.S. Pat. No. 4,097,282; U.S. Pat. No. 4,150,217; U.S. Pat. No. 4,202,785 and U.S. Pat. No. 4,252,921, the disclosures of which are incorporated herein by reference.

Highly preferred ionic polymers are poly(n-butyl acrylate-co-2-acrylamido-2-methylpropanesulfonic acid, sodium salt) (weight ratio of 25–50/75–50) and poly(n-butyl methacrylate-co-N,N,N-trimethyl-N-vinylbenzylammonium chloride) (weight ratio of 25–50/75–50).

A highly preferred transition metal complex in an electrically activatable recording layer according to the invention is $Pd(NH_3)_4Cl_2$. Another example of a highly preferred transition metal complex is $Na_2PdCl_4$. Other examples of transition metal complexes are described in U.S. Pat. No. 4,042,392, the disclosure of which is incorporated herein by reference.

Group VIIIB and Group IB metal complexes and combinations thereof are useful. The transition metal complexes need not be sensitive to radiation, such as radiation in the visible region of the electromagnetic spectrum. This enables the electrically activatable recording element to be light handleable.

The transition metal complexes in an electrically activatable recording layer according to the invention are present in a range of concentrations which enable formation of a positive image. A preferred concentration of transition metal complex is within the range of about 5 to about 150 mg/ft$^2$ (about $5\times10^{-3}$ to about $1.5\times10^{-1}$ mg/cm$^2$) of support, preferrably within the range of about 5 to about 50 mg/ft$^2$ (about $5\times10^{-3}$ to about $5\times10^{-2}$ mg/cm$^2$). The optimum concentration of transition metal complex in an electrically activatable recording layer will depend upon such factors as the desired image, the particular transition metal complex or combination of metal complexes, the particular ionic polymer in the recording layer, processing conditions and the source of energy for exposure.

A range of concentration of ionic polymer is useful in an electrically activatable recording layer according to the invention. A preferred coverage of ionic polymer in the electrically activatable recording layer is within the range of about 5 mg to about $5\times10^{+2}$ mg/ft$^2$ (0.0054 mg to 0.5 mg/cm$^2$). The concentration of ionic polymer and transition metal complex is preferrably sufficient to provide a recording layer thickness within the range of about 0.05 microns to about 5 microns, such as within about 0.1 to about 1.0 microns.

The electrically activatable recording elements are prepared by coating procedures known in the photographic art. Such procedures are described in, for example, *Research Disclosure,* December 1978, Item No. 17643, the disclosure of which is incorporated herein by reference. For example, the electrically activatable recording layer is coated on the electrically conductive support by curtain coating, doctor blade coating, air knife coating and the like. Coating solvents, such as ethanol and toluene are useful to aid coating.

An illustrative process for producing a positive image in an electrically activatable element according to the invention comprises the steps of:

(I) applying an electrical potential imagewise to the element of a magnitude and for a time sufficient to produce in the image areas a charge density within the range of about $10^{-2}$ to about $10^{-8}$ coulombs/cm$^2$, the charge density forming a latent image in the recording layer; and then (II) developing the image by means of physical development, such as with a physical developer composition or by thermal processing to produce a positive image.

The physically developable latent image in the recording layer of the element according to the invention is developed by a variety of physical developer compositions. Such physical developer compositions are described in, for example, U.S. Pat. No. 4,113,484, the description of which is incorporated herein by reference. An illustrative method of development comprises simply immersing the element containing the latent image in a physical development bath. The physical development bath generally comprises a salt of a heavy metal ion, such as silver, copper, or nickel ion, a complexing agent for the heavy metal ion, such as Rochelle salt, and a reducing agent for the heavy metal ion, such as phenolic reducing agents, including 2-methyl-3-chlorohydroquinone and catechol, isoascorbic acid, aminophenols, and boranes. Such physical development baths are described in, for example, U.S. Pat. No. 4,113,484. An illustrative thermal process according to the invention comprises:

(I) applying an electrical potential imagewise to the element of a magnitude and for a time sufficient to produce in the image areas a charge density within the range of about $10^{-2}$ to about $10^{-8}$ coulomb/cm$^2$, the charge density forming a latent image in the recording layer; then (II) laminating the resulting exposed electrically activatable recording element in face-to-face relation with a dry physical developer element; and (III) heating the laminate resulting from step (II) to a temperature and for a time sufficient to develop the latent image in the recording layer.

If desired, in step (III), the laminate can be delaminated after heating.

A preferred process according to the invention comprises an electrically activatable recording process for producing a positive image in an electrically activatable recording element comprising an electrically conductive support having thereon an electrically activatable recording layer comprising a transition metal complex consisting essentially of $Pd(NH_3)_4Cl_2$ dispersed in an ionic polymer consisting essentially of poly(n-butyl acrylate-co-2-acrylamido-2-methylpropane sulfonic acid, sodium salt) (weight ratio of 25–50/75–50), wherein the process comprises the steps of:

(I) applying an electrical potential imagewise to the element of a magnitude and for a time sufficient to produce in the image areas a charge density within the range of about $10^{-2}$ to about $10^{-8}$ coulomb/cm$^2$, the charge density forming a latent image in the recording layer;

(II) laminating the resulting exposed electrically activatable recording layer in face-to-face relation with a dry physical developer element having a physical developer layer comprising a formazan dye-forming 2,5-diphenyl-3-(1-naphthyl)-2H-tetrazolium chloride and sulfamide dispersed in a film forming copolymer of 2-hydroxyethyl acrylate and 2-hydroxyethyl methacrylate; and a developing agent consisting essentially of dimethylamineborane; and (III) heating the laminate resulting from step (II) to a temperature within the range of about 100° C. to about 180° C. for a time sufficient to develop the latent image in the recording layer.

A photoconductive layer is useful as a transducer in an electrically activatable recording element according to the invention. Any photoconductor is useful in an element according to the invention. Selection of an optimum photoconductor will depend upon such factors as the particular electrically activatable recording layer, the charge sensitivity of the element, the desired image, ohmic resistivity desired, exposure means, processing conditions and particular components in the electrically activatable recording layer. It is advantageous to select a photoconductor which has the property of being most useful with the operative voltages for imaging. The photoconductor is either an organic photoconductor or an inorganic photoconductor. Combinations of photoconductors are useful. The resistivity of the photoconductor can change rapidly in the operating voltage ranges that are useful. In some cases it is desirable that the photoconductive layer have persistant conductivity. Examples of useful photoconductors include lead oxide, cadmium sulfide, cadmium selenide, cadmium telluride and selenium. Useful organic photoconductors include, for instance, polyvinylcarbazole/-trinitrofluorenone photoconductors and aggregate type photoconductors described in, for example, U.S. Pat. No. 3,615,414.

These photoconductors are known in the electrically activatable recording art and are described in, for example, U.S. Pat. No. 3,577,272; *Research Disclosure,* August 1973, Item No. 11210; and "Electrophotography" R. M. Schaffert (1975).

An illustrative photoconductive layer comprises a dispersion of a lead oxide photoconductor in an insulating binder, such as a binder comprising a polycarbonate (for example, LEXAN, trademark of the General Electric Company, consisting of a Bisphenol A polycarbonate), polystyrene or poly(vinylbutyral).

In an embodiment according to the invention in which a photoconductive layer is a transducer, an electrically activatable recording process comprises the steps:

(I) imagewise altering the conductivity of the photoconductive layer in accord with an image to be recorded;

(II) applying an electrical potential across the photoconductive layer and the recording layer of a magnitude and for a time sufficient to produce a latent image in the recording layer corresponding to the image to be recorded; then (III) developing the resulting exposed electrically activatable recording layer by means of a physical developer. Such a process can be a thermal development process in which the development is carried out by:

(IV) laminating the exposed electrically activatable recording layer in face-to-face relation with a dry physical developer having a physical developer layer; and (V) heating the laminate resulting from step (II) to a temperature and for a time sufficient to develop the latent image in the recording layer.

Many electrically conductive supports are useful in an electrically activatable element according to the invention. The term "electrically conductive support" herein means (a) supports that are electrically conductive without the need for separate addenda in the support or on the support to produce the desired degree of electrical conductivity and (b) supports that comprise addenda or separate electrically conductive layers that enable the desired degree of electrical conductivity. Useful supports include cellulose ester, poly(vinylacetal), poly(ethylene terephthalate), polycarbonate and polyester film supports and related films and resinous materials. Other supports are useful, such as glass, paper, metal and the like which can withstand the electrical current and processing conditions and do not adverely affect the charge sensitivity and ohmic resistivity which are desired in fhe element. A flexible support is generally most useful. An example of a preferred electrically conductive support is a poly(ethylene terephthalate) film having a polymeric subbing layer, such as a poly(methyl acrylate-co-vinylidene chloride-co-itaconic acid) subbing layer and having a layer of cermet on the subbing layer.

The electrically activatable recording element according to the invention generally includes an electrically conductive layer positioned between the support and the electrically activatable recording layer. This is illustrated by electrically conductive layer 55 in FIG. 5. The electrically conductive layers as described, such as layers 59 and 55 in FIG. 5 comprise a variety of electrically conductive compounds which do not adversely affect the charge sensitivity and ohmic resistivity of an element according to the invention. Examples of useful electrically conductive layers include layers comprising an electrically conductive chromium composition such as cermet and nickel, copper, cuprous iodide and silver.

Figure 5:
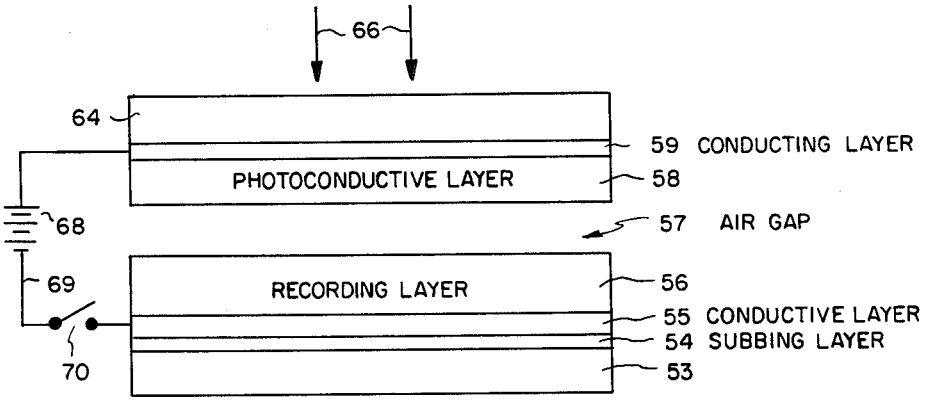
FIG. 5 illustrates schematically an image recording material that is very useful according to the invention.

In some embodiments of the invention, the photoconductive layer is a self-supporting layer, such as a photoconductor in a suitable binder. In such embodiments, an electrically conductive layer such as an electrically conductive nickel or chromium composition layer is coated on the photoconductive layer. This is illustrated in, for example, FIG. 3 in the drawings in which electrically conductive layer 28 is on photoconductive layer 30 which is self-supporting. Optionally, the photoconductive layer is coated on an electrically conductive support such as illustrated in FIG. 5 of the drawings.

The various components of the electrically activatable recording element are prepared for coating by mixing the components with suitable solutions or mixtures including suitable organic solvents, depending upon the particular electrically activatable recording material and the components. The components are added and mixed by means of procedures known in the photographic art.

Preferred electrically activatable recording elements comprise an electrically conductive support having thereon an electrically activatable recording layer which has a thickness within the range of about 0.05 micron to about 5 microns. The optimum layer thickness of each of the layers of an element according to the invention will depend upon such factors as the particular ohmic resistivity desired, charge sensitivity, particular components of the layers and the desired image.

The desired resistivity characteristics of an electrically activatable recording element according to the invention are obtained by separately measuring the current-voltage characteristic of each sample coating at room temperature by means of a mercury contact on the surface of the coating. To eliminate the possibility that a microthickness surface air gap might affect the measured resistivity, exposures are made with an evaporated metal (bismuth or aluminum) electrode on the surface of an electrically activatable recording layer to be tested. The resistivity is measured at various ambient temperatures. It is expected that the resistivity of the recording layer will vary widely with temperature. It is also expected that the dielectric strength of the layer will vary with temperature.

Many energy sources are useful for imagewise exposure of a recording element of the invention. Selection of an optimum energy source for imagewise exposure will depend upon such factors as the sensitivity of the recording layer, sensitivity of the photoconductor, the particular image recording combination in the electrically activatable recording layer, desired image and processing conditions. Useful energy sources for imagewise exposure include, for example, visible light, x-rays, lasers, electron beams, ultraviolet radiation, infrared radiation and gamma-rays. The electrically activatable recording layer is also sensitive to direct electrical contact by means of a contact electrode, such as a stylus.

An imagewise current flow is produced through the electrically activatable recording layer according to the invention. Although a particular technique to produce an imagewise current flow is described herein, preferred techniques are those which include use of a photoconductive layer as an image-to-current convertor or use of a direct contact electrode to produce sufficient current to enable formation of a latent image. The imagewise current flow is, for example, optionally provided by contacting the electrically activatable recording element with an electrostatically charged means such as an electrostatically charged stencil or scanning the recording element by means of a beam of electrons.

In a thermal process according to the invention, heating the electrically activatable recording element after latent image formation is carried out by techniques and by means known in the photothermographic art. For example, heating is carried out by passing the imagewise exposed recording element laminated to a physical development element over a heating platen or drum or through heated rolls, by heating the element by means of microwaves, dielectric heating means or heated air. A visible image is produced in the described exposed element within a short time, such as within about 1 to about 90 seconds by the described heating step. An image having a maximum transmission density of at least 1.0 and preferably at least 1.5 is produced according to the invention. For example, the recording element is uniformly heated to a temperature within the range of about 100° C. to about 180° C. until a desired image is developed, generally within about 5 to about 60 seconds. The optimum temperature and time for processing will depend upon such factors as the desired image, the particular recording element and heating means.

The electrically activatable recording element and process according to the invention are useful for producing multiple copies. According to this embodiment, multiple copies are prepared by a process comprising the steps of:

(I) imagewise altering the conductivity of a photoconductive layer in accord with an image to be recorded;

(II) positioning the imagewise altered photoconductive layer from step (I) adjacent an electrically activatable recording layer of the invention;

(III) applying an electrical potential across the photoconductive layer and recording layer of a magnitude and for a time sufficient to produce in the areas of the recording layer corresponding to the imagewise altered portions of the photoconductive layer a current density within the range of about $10^{-5}$ to about $10^{-8}$ coulomb/sq.cm, the current density forming, in the image areas, a developable latent image; then (IV) developing the image in the recording layer by means of a physical developer; followed by (V) positioning the imagewise altered photoconductive layer adjacent a second electrically activatable recording layer, preferably having an ohmic resistivity of at least about $10^7$ ohm/cm; then (VI) applying an electrical potential across the photoconductive layer and the second recording layer of a magnitude and for a time sufficient to produce in the areas of the image of the photoconductive layer a charge density within the range of about $10^{-5}$ to about $10^{-8}$ coulomb/sq.cm, the charge density forming a developable latent image; then (VII) developing the second recording layer by means of a physical developer to produce a developed positive image in the second recording layer.

Figure 2:
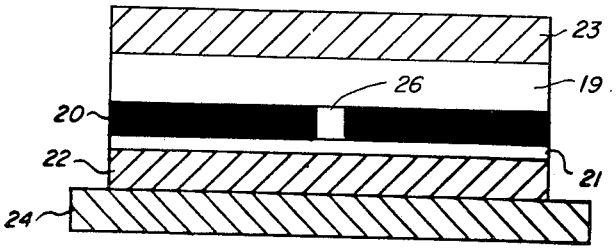

Referring to the drawings, embodiments of the invention are depicted schematically in FIGS. 1 and 2. According to the embodiment in FIG. 1, an electrically activatable recording layer 10 and an electrically conductive layer 11, such as a cermet layer, are coated on support 12. A current is selectively applied to the recording layer 10 by the point of a metal stylus 14 which is raised to a sufficiently high voltage relative to the support 12 by a voltage source 16 and brought into moving contact with the surface of recording layer 10 containing the transition metal complex in an ionic polymer according to the invention. Upon contacting the recording layer 10 with the stylus 14 a current flow is produced in the areas such as area 18 of the recording layer contacted by the stylus. A developable image forms, illustrated by area 18 in layer 10. The current density produced by the stylus in the contacted areas of the recording layer need not be sufficient to produce a visible image in the recording layer 10. The current density must be sufficient to produce a developable image in the recording layer. Although a particular technique to produce an imagewise current flow through the recording layer 10 is illustrated in FIG. 1, techniques for producing an imagewise current flow generally known in the art of recording are useful and are intended to be encompassed by the description. The area of the recording layer 10 designated as 18 is intended to be illustrative of a developable image formed upon contact of the stylus 14 with the recording layer 10. In those areas designated as 18, the ionic polymer is reoriented to produce areas in which development is prevented or hindered enabling formation of a positive image. Other examples for producing a pattern of image sites include, for example, scanning the layer 10 by means of a beam of electrons in an image pattern.

FIG. 2 illustrates development of the developable image formed in the recording element in FIG. 1 by, for example, moving the element from FIG. 1 into contact with a heated metal platen 24. The heat from platen 24 passes through the support 22 and electrically conductive layer 21 to the layer 20 containing the developable image. The layer 20 is placed in face-to-face relationship with a physical development element comprising physical developer layer 19 on support 23. The components necessary for physical development pass from layer 19 into layer 20 in the unexposed areas of layer 20 causing physical development. After development the physical developer element comprising layer 19 on support 23 is removed from recording layer 20. In this embodiment no processing solutions or baths are required to produce a positive image. Optionally, a positive image in layer 20 is developed by means of a physical developer solution or bath without the need for a physicl developer element comprising layer 19.

Figure 3:
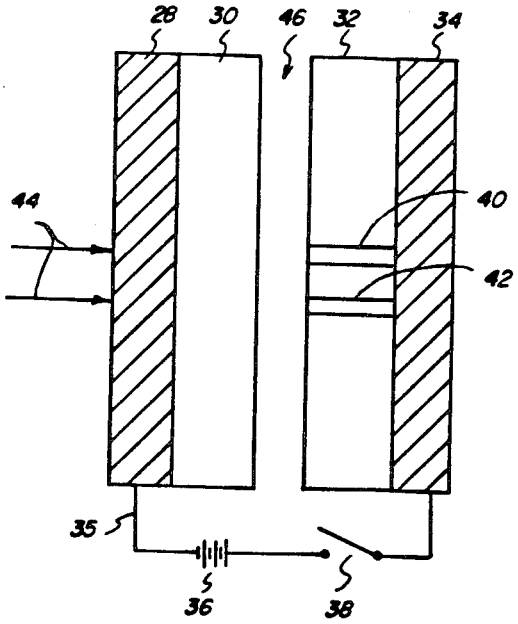
FIGS. 3 and 4 illustrate schematically an electrically activatable recording material and process embodying the described invention.
Figure 4:
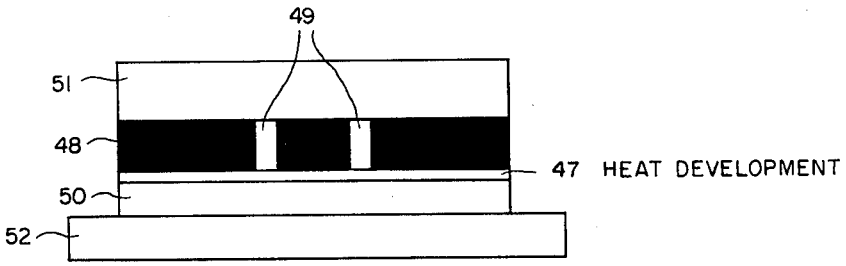

Another illustrative embodiment of the invention is schematically shown in FIGS. 3 and 4. In this embodiment in FIG. 3 the development sites 40 and 42, that is the developable image sites, are formed by sandwiching an electrically activatable recording layer 32 and an image to current converter layer 30, preferably a photoconductive layer, between a pair of electrically conductive layers 28 and 34. Layers 28 and 34 comprise electrically conductive supports for layers 30 and 32 or layers 28 and 34 can be on separate supports not shown, such as film supports. A high potential electric field, such as a voltage within the range of about 0.01 to about 6.0 kv, is established across the photoconductive layer 30 and recording layer 32 by connecting the conductive layers 28 and 34 by connecting means 35 containing power source 36. The electric field across the layers is controlled by switch 38. The developable image formation at sites 40 and 42 is caused by imagewise exposing the photoconductive layer 30 through the conductor 28 to exposure means 44. Exposure means 44 generally comprises actinic radiation. The layer 28 and any support for layer 28 must be sufficiently transparent to the energy 44 to enable the energy to pass to a desired degree to photoconductive layer 30. The exposure selectively increases the conductivity of the photoconductive layer in those regions exposed to actinic radiation. When switch 38 is in a closed condition, thereby producing an electric field across the layers, an imagewise current flow is produced through the recording layer 32. The current flow occurs in those regions of the recording layer 32 only in position with the exposed portions of the photoconductive layer 30. An air gap 46 of up to 20 microns is provided between the layer 30 and 32 or 46 may comprise an electrically conductive interlayer, not shown, which does not adversely affect imaging. The air gap 46 is, for example, 1 to 20 microns. After a sufficient charge density has been produced in the current exposed portions of the recording layer 32, switch 38 is open, thereby disrupting the current flow.

The described technique for application of voltage across the photoconductive and recording layers is illustrative. Techniques known in the recording art are useful and are intended to be included. For example, a grid controlled corona discharge means, not shown, such as described in U.S. Pat. No. 3,370,212 is useful in place of the voltage source in conducting layer 28.

To develop the positive image in layer 32, the recording element containing layers 34 and 32 is moved away from the photoconductive layer 30. Connecting means 35 is also disconnected. The recording element illustrated in FIG. 4 is then developed by means of a physical developer bath or solution, not shown. Optionally, the recording element illustrated in FIG. 4 is contacted with a heating means such as a heated platen 52 illustrated in FIG. 4. The heat from the platen 52 passes through the support 50 and electrically conductive layer 47 to the layer 48 containing a developable image in areas 49. Layer 48 is placed in face-to-face relation with a physical developer element 51 containing the components necessary to transfer to and develop a positive image in layer 48. Heating is preferably carried out substantially uniformly by positioning the recording element in heat transfer relationship with the heated platen 52. After development, the recording element is removed from the platen 52 and from the physical developer element 51.

An illustrative embodiment of the invention is illustrated in FIG. 5. In FIG. 5 the recording arrangement consists of a support 53 having thereon a polymeric subbing layer 54, such as a poly(alkyl acrylate-co-vinylidene chloride-co-itaconic acid) subbing layer, having thereon an electrically conductive layer 55, preferably comprising cermet, and having thereon an electrically activatable recording layer 56 according to the invention. The subbing layer 54 helps the conductive layer 55 adhere to the support 53. A recording layer 56 is placed, such as by coating, on the electrically conductive layer 55. The recording layer 56 contains the transition metal complex dispersed in an ionic polymer according to the invention. An air gap 57, such as up to 20 microns, is present between the recording layer 56 and a photoconductive layer 58. The air gap 57 is optionally replaced by an electrically conductive interlayer that does not adversely affect image recording. The layer 58 is contiguous to an electrically conductive layer 59, such as a nickel layer, which is on a transparent film support 64.

A developable image is formed in recording layer 56 by imagewise exposure by means of a suitable radiation source 66, such as a tungsten light source or x-ray source. At the time of imagewise exposure by means of energy source 66, a high potential electrical field, such as at a voltage within the range of about 0.01 to 6.0 kv is established across the photoconductive and image recording layers by connecting the conductive layer 59 and electrically conductive layer 55 by connecting means 69 through a power source 68. The electric field across the layers is controlled by a switch 70. After the necessary current density is established, switch 70 is opened, thereby disrupting the current flow. Imagewise exposure for about 10 seconds at about 55 foot candles produces a developable image in recording layer 56. To develop the resulting latent image, layer 55 is disconnected from connecting means 69 and power source 68 and the element containing layer 56 is moved away from the photoconductive layer 58. The recording layer 56 is then developed by means of a physical developer solution to produce a positive image in the unexposed areas of layer 56.

A variety of binders and sensitizers known in the electrophotographic art are useful in photoconductive layer 58 illustrated in FIG. 5. Useful binders are described in, for example, U.S. Pat. No. 2,361,019 and U.S. Pat. No. 2,258,423. Sensitizing compounds useful in the photoconductive layer are described in, for example, U.S. Pat. No. 3,978,335.

In the embodiments illustrated which comprise an air gap between the photoconductive layer and the image recording layer, the air gap distances are controlled by methods known in the art, such as by the roughness of the surface of the photoconductive layer as well as the roughness of the surface of the image recording layer. The air gap need not be uniform; however, best results are observed when an uniform air gap exists between the photoconductive layer and the image recording layer.

The resistivity of a recording layer according to the invention is affected by the air gap. The number of variables affecting the resistance of the recording layer affects the choice of optimum recording materials and imaging means. The resistivity values described herein are for particular recording materials and are values measured under optimum temperature conditions during exposure. If desired, the recording element and imaging means according to the invention are modified to provide a continuous image recording operation. This is carried out by means of desired control circuitry and continuous transport apparatus, not shown.

The following examples are included for a further understanding of the invention.

EXAMPLE 1

This illustrates the invention.

The element and layers for this example were like those illustrated in FIG. 5.

An electrically activatable recording element was prepared by mixing the following:

| | |
|---|---|
| $Pd(NH_3)_4Cl_2$ | 0.0463 g |
| Poly(n-butyl acrylate-co-2-acrylamido-2-methylpropanesulfonic acid, sodium salt) (weight ratio 25/75) (ionic polymer) | 2.0 g |
| Surfactant (Igepal CO-630 which is a trademark of and available from GAF Corp., and identified as a nonionic surfactant that is a condensation product of an alkylphenol and ethylene oxide) | 1.0 g |
| Water | to one liter |

The resulting composition was coated at 1.0 ml/ft$^2$ (0.0011 ml/cm$^2$) on an electrically conductive support. The electrically conductive support consisted of a poly(ethylene terephthalate) film support having thereon a subbing layer comprising poly(methyl acrylate-co-vinylidene chloride-co-itaconic acid) and, on the subbing layer, a layer of cermet. The water was removed by permitting the resulting element to dry at room temperature (about 20° C.). The resulting electrically activatable recording layer contained 20 mg/ft$^2$ ($2.1\times10^{-2}$ mg/cm$^2$) of poly(n-butyl acrylate-co-2-acrylamido-2-methylpropanesulfonic acid, sodium salt) (weight ratio 25/75) and 0.020 mg $Pd^{+2}$/ft$^2$ ($2.1\times10^{-5}$ mg $Pd^{+2}$/cm$^2$).

The electrically activatable recording element (see FIG. 5) was imagewise exposed by means of a tungsten light source and a silver test target. The light was passed onto a light-to-current transducer which was a 90 micron thick layer of tetragonal lead oxide photoconductor on an electrically conductive support. The electrically conductive support consisted of a poly(ethylene terephthalate) film having thereon a transparent layer of nickel. Exposures were for ten seconds and sufficient to produce a developable image in the electrically activated recording layer. During exposure a voltage of +1800 V was applied through connecting means 69 (switch 70 being in a closed condition) to layer 59 and layer 55. A positive polarity was applied to the photoconductive layer.

After exposure, the portion of the sandwich containing the electrically activatable recording layer 56 was separated and was thermally laminated by means of heated rollers at 65° C. at 1 inch/second (2.54 cm/second) in face-to-face relationship, to a dry fromazan dye forming physical development (DFDPD) layer on a poly(ethylene terephthalate) film support. The poly(ethylene terephthalate) film support contained a subbing layer consisting of a 0.4 micron thick layer of poly(vinyl alcohol) (Elvanol 70-05 which is a trademark of and available from E. I. duPont Co., United States).

The poly(ethylene terephthalate) cover sheet was then removed and the developable image in the electrically activatable recording layer was amplified by heating the resulting material for five seconds at 140° C. A good quality positive image of the silver test target was produced. The developed image had a maximum density of 0.70 and a minimum density of 0.15.

The DFDPD material was prepared by coating a formazan dye forming composition at a 10 mil (254.0 microns) wet coating thickness onto a polyester film support which had been previously coated with 1.32 ml/ft$^2$ ($1.4\times10^{-3}$ ml/cm$^2$) of a 3% by weight aqueous solution of poly(vinyl alcohol) (Elvanol 70-05 identified above) containing 3% (by weight of polymer) of surfactant (Igepal CO-630). On the layer containing Elvanol 70-05 was coated, at a ten mil (254.0 microns) wet coating thickness, the following formazan dye forming composition:

| | |
|---|---|
| (a) 2,5-diphenyl-3-(1-naphthyl)-2H—tetrazolium chloride (dye forming compound) | 500 mg dissolved in 1 ml of ethanol |
| (b) sulfamide (melt former) | 200 mg dissolved in 1 ml of ethanol |
| (c) poly(2-hydroxyethyl acrylate-co-2-hydroxyethyl methacrylate) (weight ratio 70/30) (binder) | 15 ml of a 5.85% by weight solution in water |
| (d) dimethylamine borane (reducing agent) | 1.5 ml of a 2.5% by weight solution in water |
| (e) surfactant (Surfactant 1OG with is a trademark of and available from the Olin Corp., U.S.A. and is identified as para-iso nonylphenoxypolyglycidol) | 0.2 ml of a 5% by weight aqueous solution |

EXAMPLES 2–10

These examples further illustrate the invention.

The procedure described in Example 1 was repeated with the exceptions listed in following Table A. In Table A the polymer numbers are as follows:

| Polymer No. | Polymer |
|---|---|
| 2 | Poly(n-butyl acrylate-co-2-acrylamido-2-methylpropanesulfonic acid, sodium salt) (weight ratio 50/50) |
| 3 | Poly(acrylamide-co-2-acrylamido-2-methylpropanesulfonic acid, sodium salt) (weight ratio 80/20) |
| 4 | Poly[methyl methacrylate-co-N—(2-methacryloyloxyethyl)-N,N,N—trimethylammonium methosulfate] (weight ratio 67/33) |
| 5 | Poly[decamethylene-co-1,4-cyclohexylenedioxydiethylene (80:20) sebacate-co-5-(4-sodiosulfophenoxy-1,3-phenylenedicarboxylate (weight ratio 70/30)] |
| 6 | Poly[decamethylene sebacate-co-5-(4-sodiosulfophenyl)-1,3-phenylenedicarboxylate (weight ratio 70/30)] |
| 7 | Poly[N—(m- and p-vinylbenzyl)-N,N,N—trimethylammonium chloride] |

TABLE A

| Example No. | Polymer No. | Polymer Coverage mg/ft$^2$ (mg/cm$^2$) | $Pd(NH_3)_4Cl_2$ Coverage mg/ft$^2$ (mg/cm$^2$) | Exposure (time, seconds) & Voltage | D-max | D-min |
|---|---|---|---|---|---|---|
| 2 | 2 | 20 ($2.1\times10^{-2}$) | 0.020 ($2.1\times10^{-5}$) | 12 +1800 V | 0.84 | 0.15 |
| 3 | 3 | 20 ($2.1\times10^{-2}$) | 0.020 ($2.1\times10^{-5}$) | 12 +1800 V | 0.42 | 0.21 |
| 4 | 2 | 20 ($2.1\times10^{-2}$) | 0.020 ($2.1\times10^{-5}$) | 16 −1800 V | 0.79 | 0.26 |
| 5 | 4 | 20 ($2.1\times10^{-2}$) | 0.020 ($2.1\times10^{-5}$) | 8 +2300 V | 0.46 | 0.24 |
| 6 | 5 | 20 ($2.1\times10^{-2}$) | 0.010 ($1.05\times10^{-5}$) | 8 +2300 V | 0.40 | 0.16 |
| 7 | 5 | 20 ($2.1\times10^{-2}$) | 0.010 ($1.05\times10^{-5}$) | 12 −2600 V | 0.37 | 0.16 |

TABLE A-continued

| Example No. | Polymer No. | Polymer Coverage mg/ft$^2$ (mg/cm$^2$) | $Pd(NH_3)_4Cl_2$ Coverage mg/ft$^2$ (mg/cm$^2$) | Exposure (time, seconds) & Voltage | D-max | D-min |
|---|---|---|---|---|---|---|
| 8 | 6 | 20 ($2.1 \times 10^{-2}$) | 0.010 ($1.05 \times 10^{-5}$) | 8 +2300 V | 0.42 | 0.16 |
| 9 | 6 | 20 ($2.1 \times 10^{-2}$) | 0.010 ($1.05 \times 10^{-5}$) | 16 −2300 V | 0.41 | 0.21 |
| 10 | 7 | 10 ($1.05 \times 10^{-2}$) | 0.10 ($1.05 \times 10^{-5}$) | 30 +1800 V | 0.74 | 0.33 |

The invention has been described in detail with particular reference to preferred embodiments thereof, but it will be understood that variations and modifications can be effected within the spirit and scope of the invention.

What is claimed is:

1. In an electrically activatable recording element comprising an electrically conductive support having thereon an electrically activatable recording layer capable of producing a positive image, the improvement wherein said recording layer comprises a transition metal complex selected from the group consisting of Group VIIIB and Group IB metal complexes and a film forming ionic polymer that is capable of undergoing an imagewise reorientation upon exposure to electric current and as a result of said exposure, development of said metal complex in the exposed areas of said recording layer is restricted.

2. An electrically activatable recording element as in claim 1 wherein said ionic polymer comprises at least 25 mole percent of recurring units comprising ionic groups.

3. An electrically activatable recording element as in claim 1 wherein said ionic polymer comprises a vinyl polymer comprising recurring units of the structure:

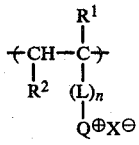

wherein

L is a linking group selected from alkylene containing 1 to 25 carbon atoms, arylene containing 6 to 30 carbon atoms, arylenealkylene containing 7 to 30 carbon atoms, —COOR$^3$, —OCOR$^3$—, —CONHR$^3$ or taken together with R$^2$ forms a

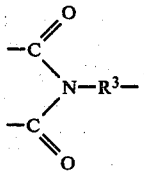

group;

R$^1$ is hydrogen or alkyl containing 1 to 4 carbon atoms;

R$^2$ is hydrogen or taken together with L forms a

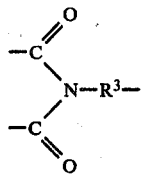

group;

R$^3$ is alkylene containing 1 to 25 carbon atoms, arylene containing 6 to 30 carbon atoms, or arylenealkylene containing 7 to 30 carbon atoms;

Q is a cationic ammonium or phosphonium group;

n is 0 or 1; and,

X is an anion.

4. An electrically activatable recording element as in claim 3 wherein Q is a cationic group represented by the formula:

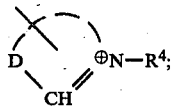

a phosphonium group represented by the formula:

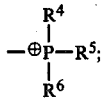

or an ammonium group represented by the formula:

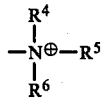

wherein

R$^4$, R$^5$ and R$^6$ are individually selected from alkyl containing 1 to 25 carbon atoms, and aryl containing 6 to 30 carbon atoms; and, D represents the atoms selected from the group consisting of carbon, hydrogen, nitrogen, oxygen and sulfur atoms necessary to complete a heterocyclic nucleus.

5. An electrically activatable recording element as in claim 3 wherein said vinyl polymer is a copolymer of a comonomer selected from the group consisting of acrylate and methacrylate comonomers.

6. A electrically activatable recording element as in claim 3 wherein said ionic polymer is a copolymer of a comonomer selected from the group consisting of styrene, vinyltoluene, ethyl acrylate and butyl methacrylate.

7. An electrically activatable recording element as in claim 1 wherein said ionic polymer is an anionic polymer comprising recurring units of the structure:

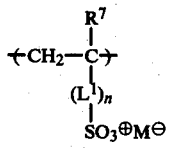

wherein $R^7$ is hydrogen or alkyl containing 1 to 4 carbon atoms;

$L^1$ is a linking group selected from alkylene containing 1 to 25 carbon atoms, arylene containing 6 to 30 carbon atoms, arylenealkylene containing 7 to 30 carbon atoms, and

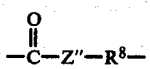

wherein

Z'' is oxygen or imino (—NH—), and $R^8$ is alkylene containing 1 to 25 carbon atoms, arylenealkylene containing 7 to 30 carbon atoms or arylene containing 6 to 30 carbon atoms;

$M^{\oplus}$ is a cation; and n is 0 or 1.

8. An electrically activatable recording element as in claim 1 wherein said ionic polymer is an anionic polymer comprising recurring units of the structure:

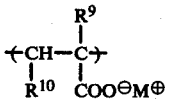

wherein $R^9$ is hydrogen or alkyl containing 1 to 4 carbon atoms;

$R^{10}$ is hydrogen, alkyl containing 1 to 4 carbon atoms, or $COO^{\ominus}M^{\oplus}$; and, $M^{\oplus}$ is a cation.

9. An electrically activatable recording element as in claim 1 wherein said ionic polymer is a cationic copolymer comprising a crosslinkable active methylene group selected from 2-acetoacetoxyethyl methacrylate, acryloylacetone, glycidyl methacrylate, and vinylbenzaldehyde groups.

10. An electrically activatable recording element as in claim 1 wherein said ionic polymer is an ionic condensation polymer comprising recurring units selected from the structures:

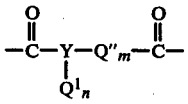

-continued

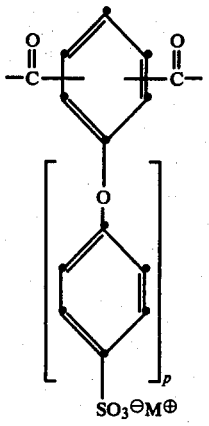

and

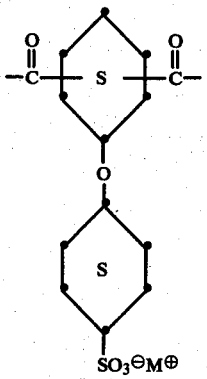

wherein n, m and p are individually 0 or 1, and the sum of n plus m is 1;

Q'' is

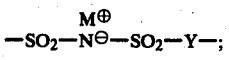

$Q^1$ is

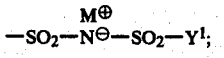

Y is phenylene or naphthylene;

$Y^1$ is alkyl containing 1 to 12 carbon atoms or aryl containing 6 to 30 carbon atoms;

$M^{\oplus}$ is a cation.

11. An electrically activatable recording element as in claim 1 wherein said electrically activatable recording layer comprises a transition metal complex consisting essentially of $Pd(NH_3)_4Cl_2$ dispersed in a charged polymer consisting essentially of poly(n-butyl acrylate-co-2-acrylamido-2-methylpropanesulfonic acid, sodium salt) (weight ratio of 25–50/75–50).

12. An electrically activatable recording element as in claim 1 wherein said electrically activatable recording layer comprises a transition metal complex consisting essentially of $Pd(NH_3)_4Cl_2$ in a charged polymer consisting essentially of poly(n-butyl methacrylate-co-N,N,N-trimethylbenzylammonium chloride).

13. In an electrically activatable recording element, capable of producing a positive image, comprising an electrically conductive support having thereon, in sequence:

(a) an electrically activatable recording layer comprising a metal complex dispersed in a polymeric binder, (b) a photoconductive layer separated from (a) by (i) an air gap of up to 20 microns or (ii) an electrically conductive interlayer, and (c) an electrically conductive layer, the improvement wherein said recording layer comprises a transition metal complex selected from the group consisting of Group VIIIB and Group IB metal complexes and a film forming ionic polymer which is capable of undergoing an imagewise reorientation upon exposure to electric current and, upon exposure, development of said metal complex in the exposed areas of said recording layer is restricted.

14. An electrically activatable recording element as in claim 13 wherein said ionic polymer comprises at least 50 mole percent of recurring units comprising ionic groups.

15. An electrically activatable recording element as in claim 13 wherein said ionic polymer comprises a vinyl polymer comprising recurring units of the structure:

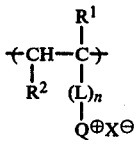

wherein

L is a linking group selected from alkylene containing 1 to 35 carbon atoms, arylene containing 6 to 30 carbon atoms, arylenealkylene containing 7 to 30 carbon atoms, —$COOR^3$, —$OCOR^3$—, or taken together with $R^2$ forms a

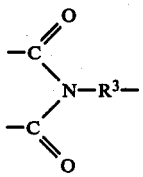

group;

$R^1$ is hydrogen or alkyl containing 1 to 4 carbon atoms;

$R^2$ is hydrogen or taken together with L forms a

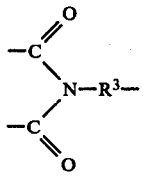

group;

$R^3$ is alkylene containing 1 to 25 carbon atoms, arylene containing 6 to 30 carbon atoms, or arylenealkylene containing 7 to 30 carbon atoms;

Q is a cationic ammonium or phosphonium group;

n is 0 or 1; and,

X is an anion.

16. An electrically activatable recording element as in claim 15 wherein said vinyl polymer is a copolymer of a comonomer selected from the group consisting of acrylate and methacrylate comonomers.

17. An electrically activatable recording element as in claim 13 wherein said electrically activatable recording layer comprises a transition metal complex consisting essentially of $Pd(NH_3)_4Cl_2$ in a charged polymer consisting essentially of poly(n-butyl acrylate-co-2-acrylamido-2-methylpropanesulfonic acid, sodium salt) (weight ratio of 25–50/75–50).

18. An electrically activatable recording element as in claim 13 wherein said electrically activatable recording layer comprises a transition metal complex consisting essentially of $Pd(NH_3)_4Cl_2$ in an ionic polymer consisting essentially of poly(n-butyl methacrylate-co-N,N,N-trimethylbenzylammonium chloride).

19. An electrically activatable recording element as in claim 1 wherein said electrically conductive support comprises a poly(ethylene terephthalate) film having thereon a polymeric subbing layer and an electrically conductive cermet layer.

20. An electrically activatable recording process for producing a positive image in an electrically activatable recording element comprising an electrically conductive support having thereon an electrically activatable recording layer comprising a transition metal complex selected from the group consisting of Group VIIIB and Group IB metal complexes and a film forming ionic polymer which is capable of undergoing an imagewise reorientation upon exposure to electric current and, upon exposure, development of said metal complex in the exposed areas of said recording layer is restricted, said process comprising the steps of:

(I) applying an electrical potential imagewise to said element of a magnitude and for a time sufficient to produce in the image areas a charge density within the range of about $10^{-2}$ to about $10^{-8}$ coulomb/$cm^2$, said charge density forming a latent image in said recording layer; and (II) physically developing said latent image by means of a physical developer composition.

21. An electrically acativatable recording process as in claim 20 wherein said physical developer composition comprises a bath comprising salt of a heavy metal ion, a complexing agent for the heavy metal ion and a reducing agent for the heavy metal ion.

22. An electrically activatable recording process for producing a positive image in an electrically activatable recording element comprising an electrically conductive support having thereon an electrically activatable recording layer comprising a transition metal complex selected from the group consisting of Group VIIIB and Group IB metal complexes and a film forming ionic polymer which is capable of undergoing an imagewise reorientation upon exposure to electric current and, upon exposure, development of said metal complex in the exposed areas of said recording layer is restricted, said process comprising the steps of:

(I) applying an electrical potential imagewise to said element of a magnitude and for a time sufficient to produce in the image areas a charge density within the range of about $10^{-2}$ to about $10^{-8}$ coulomb/$cm^2$, said charge density forming a latent image in said recording layer;

(II) laminating the resulting exposed electrically activatable recording element in face-to-face relation with a dry physical developer element; and (III) heating the laminate resulting from step (II) to a temperature and for a time sufficient to develop the latent image in said recording layer.

23. An electrically activatable recording process as in claim 22 wherein in step (III) said laminate is delaminated after heating.

24. An electrically activatable recording process for producing a positive image in an electrically activatable recording element comprising an electrically conductive support having thereon an electrically activatable recording layer comprising a transition metal complex consisting essentially of $Pd(NH_3)_4Cl_2$ dispersed in an ionic polymer consisting essentially of poly(n-butyl acrylate-co-2-acrylamido-2-methylpropanesulfonic acid, sodium salt) (weight ratio of 25–50/75–50), said process comprising the steps of:

(I) applying an electrical potential imagewise to said element of a magnitude and for a time sufficient to produce in the image areas a charge density within the range of about $10^{-2}$ to about $10^{-8}$ coulomb/cm$^2$, said charge density forming a latent image in said recording layer;

(II) laminating the resulting exposed electrically activatable recording layer in face-to-face relation with a dry physical developer element having a physical developer layer comprising, a formazan dye forming 2,5-diphenyl-3-(1-naphthyl)-2H-tetrazolium chloride, sulfamide dispersed in a film forming copolymer of 2-hydroxyethyl acrylate and 2-hydroxyethyl methacrylate, and a developing agent consisting essentially of dimethylamine borane; and, (III) heating the laminate resulting from step (II) to a temperature within the range of about 100° C. to about 180° C. for a time sufficient to develop the latent image in said recording layer.

25. An electrically activatable recording process for producing a positive image in an electrically activatable recording element comprising, in sequence:

(a) an electrically conductive layer, (b) a photoconductive layer, (c) an electrically activatable recording layer separate from (b) by (i) an air gap of up to 20 microns or (ii) an electrically conductive polymer interlayer, and comprising an transition metal complex selected from the group consisting of Group VIIIB and Group IB metal complexes and a film forming ionic polymer that is capable of undergoing an imagewise reorientation upon exposure to electric current and, upon exposure, development of said metal complex in the exposed areas of said recording layer is restricted, on (d) an electrically conductive support said process comprising the steps (I) imagewise altering the conductivity of said photoconductive layer in accord with an image to be recorded;

(II) applying an electrical potential across said photoconductive layer and said recording layer of a magnitude and for a time sufficient to produce a latent image in said recording layer corresponding to the image to be recorded;

(III) laminating the resulting exposed electrically activatable recording layer in face-to-face relation with a dry physical developer element having a physical developer layer, and (IV) heating the laminate resulting from step (II) to a temperature and for a time sufficient to develop the latent image in said recording layer.

26. An electrically activatable recording process as in claim 25 wherein in step (IV) said laminate is delaminated after heating.

27. An electrically activatable recording process for producing a positive image in an electrically activatable recording element comprising, in sequence:

(a) a first transparent support having thereon (b) a first electrically conductive layer, (c) a photoconductive layer, having thereover (d) an electrically activatable recording layer, separated from (c) by (i) an air gap of up to 20 microns or (ii) an electrically conductive polymer interlayer, and comprising a transition metal complex consisting essentially of $Pd(NH_3)_4Cl_2$ dispersed in a charged polymer consisting essentially of poly(n-butyl acrylate-co-2-acrylamido-2-methylpropanesulfonic acid, sodium salt) (weight ratio of 25–50/75–50), (e) an electrically conductive cermet layer, and (f) a second support, said process comprising the steps of:

(I) imagewise altering the conductivity of said photoconductive layer in accord with an image to be recorded;

(II) applying an electrical potential across said photoconductive layer and said recording layer of a magnitude and for a time sufficient to produce a latent image in said recording layer corresponding to the image to be recorded;

(III) laminating the resulting exposed electrically activatable recording layer in face-to-face relation with a dry physical developer element having a physical developer layer comprising a formazan dye forming 2,5-diphenyl-3-(1-naphthyl)-2H-tetrazolium chloride, dispersed in a film forming copolymer of 2-hydroxyethyl acrylate and 2-hydroxyethyl methacrylate, a thermal solvent consisting essentially of sulfamide, and a developing agent consisting essentially of dimethylamine borane; and (IV) heating the laminate resulting from step (II) to a temperature within the range of about 100° C. to about 180° C. for a time sufficient to develop the latent image in said recording layer.

* * * * *